US007287480B2

(12) United States Patent
Lin

(10) Patent No.: US 7,287,480 B2
(45) Date of Patent: Oct. 30, 2007

(54) NAUTICAL TRANSPORT VEHICLE HAVING ENHANCED STABILITY

(76) Inventor: Kang-Chin Lin, 38, Alley 21, Lane 370, The-Lun Rd., Jen-The Hsiang (TW)

( * ) Notice: Subject to any disclaimer, the term of this patent is extended or adjusted under 35 U.S.C. 154(b) by 15 days.

(21) Appl. No.: 11/219,619

(22) Filed: Sep. 1, 2005

(65) Prior Publication Data

US 2007/0044701 A1 Mar. 1, 2007

(51) Int. Cl.
*B63B 1/10* (2006.01)

(52) U.S. Cl. ..... 114/61.12; 114/61.13; 114/61.14; 114/126

(58) Field of Classification Search ..... 114/126, 114/274, 280, 281, 61.12, 61.13, 61.14, 129, 114/140, 166, 167
See application file for complete search history.

(56) References Cited

U.S. PATENT DOCUMENTS

| | | | | | |
|---|---|---|---|---|---|
| 1,712,167 | A | * | 5/1929 | Pontikis | 114/348 |
| 3,006,307 | A | * | 10/1961 | Johnson | 114/278 |
| 3,092,062 | A | * | 6/1963 | Savitsky | 114/277 |
| 3,208,422 | A | * | 9/1965 | Schopmeyer | 114/281 |
| 3,354,857 | A | * | 11/1967 | Hobday | 114/282 |
| 3,995,575 | A | * | 12/1976 | Jones, Jr. | 114/280 |
| 4,040,373 | A | * | 8/1977 | Jones, Jr. | 114/126 |
| 4,782,779 | A | * | 11/1988 | Heyrman et al. | 114/63 |
| 5,794,558 | A | * | 8/1998 | Loui | 114/274 |

* cited by examiner

*Primary Examiner*—Sherman Basinger
(74) *Attorney, Agent, or Firm*—Alan Kamrath; Kamrath & Associates P.A.

(57) ABSTRACT

A nautical transport vehicle includes at least one floating member, at least one longitudinal fin pivotally mounted on the floating member, and at least one corresponding plate mounted on the floating member and parallel with the longitudinal fin. Thus, the nautical transport vehicle is immersed in the water stably to form a balance support, so that the ship mounted on the nautical transport vehicle is flush rested on the water surface smoothly to obtain tension and buoyancy efficiently.

8 Claims, 16 Drawing Sheets

NAUTICAL TRANSPORT VEHICLE HAVING ENHANCED STABILITY

The present invention relates to a nautical transport vehicle having highly enhanced multi-directional stability.

A conventional nautical transport vehicle in accordance with the prior art shown in FIG. 1 is a row-shaped raft 1 consisting of a plurality of juxtaposed barrels 11 connected together. Thus, the conventional raft 1 has a larger contact area with the water surface, so that the conventional raft 1 has a greater stability. However, the conventional raft 1 has a slower velocity.

Another conventional nautical transport vehicle in accordance with the prior art shown in FIGS. 2 and 3 is a boat 2 having a V-shaped bottom. However, the conventional raft boat 2 has a greater stability, so that the conventional raft boat 2 is easily turned over.

In accordance with the present invention, there is provided a nautical transport vehicle, comprising:

at least one floating member;

at least one longitudinal fin pivotally mounted on the floating member; and at least one corresponding plate mounted on the floating member and parallel with the longitudinal fin, thereby defining a gap between the corresponding plate and the longitudinal fin to allow a water flow passing through the gap so as to reduce a resistance to a forward movement of the water flow and to adjust a turning angle of the floating member.

Figure 1:
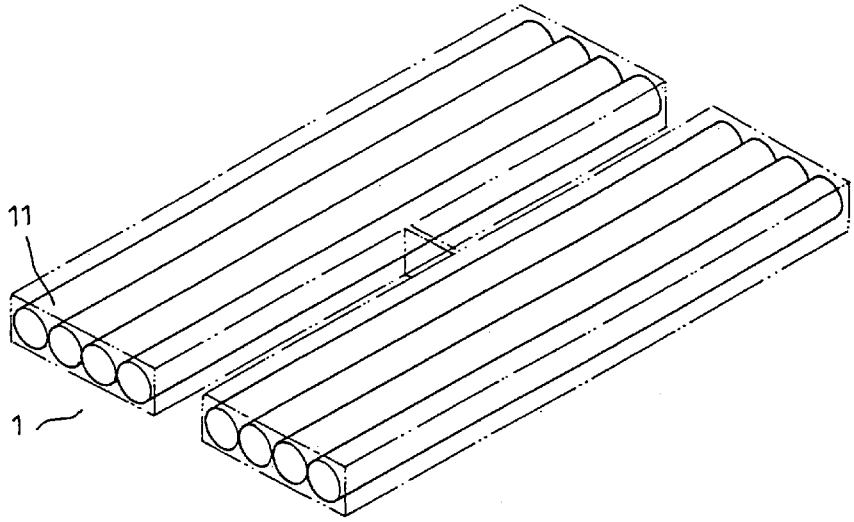
FIG. 1 PRIOR ART
FIG. 1 is a perspective view of a conventional nautical transport vehicle in accordance with the prior art.
Figure 5:
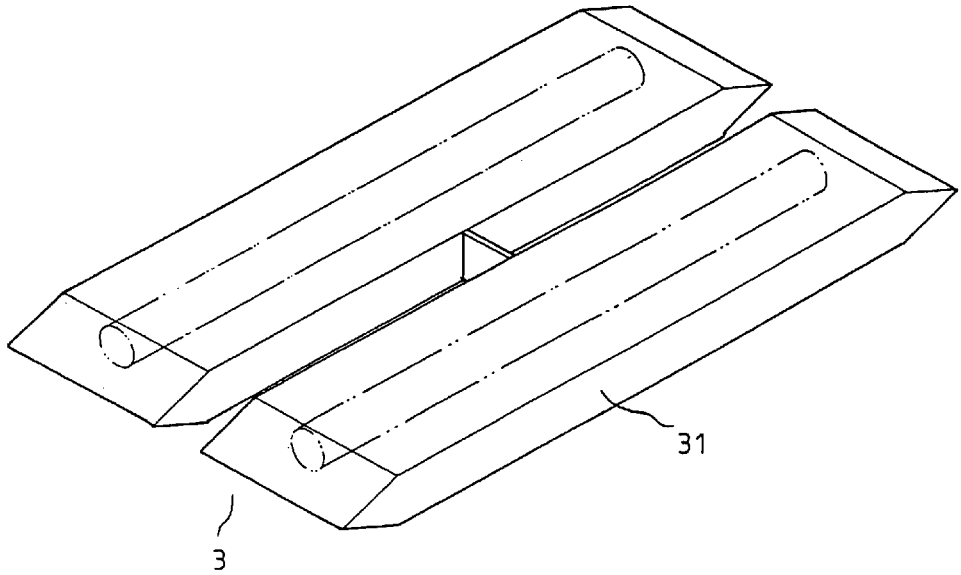
FIG. 5 is a partially perspective view of the nautical transport vehicle as shown in FIG. 4.
Figure 2:
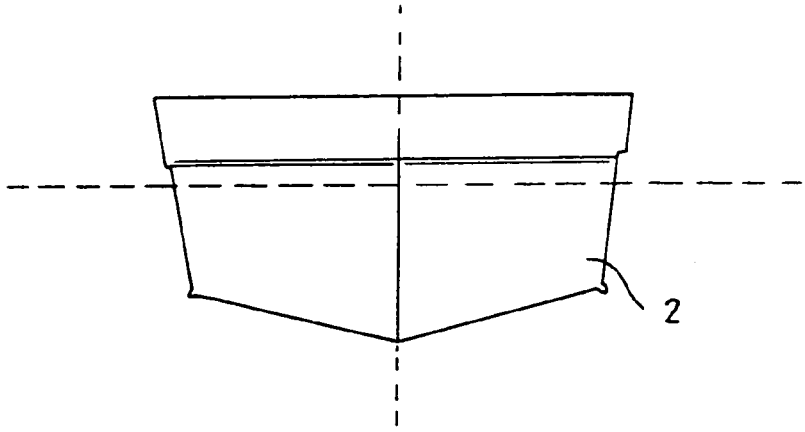
FIG. 2 PRIOR ART
FIG. 2 is a plan view of another conventional nautical transport vehicle in accordance with the prior art.
Figure 3:
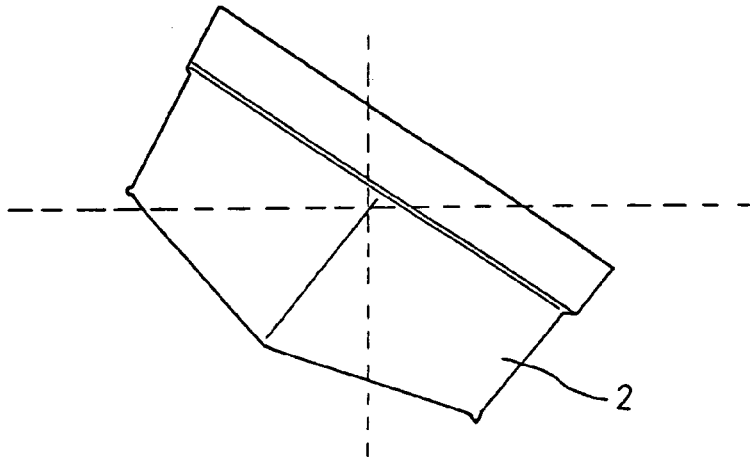
FIG. 3 PRIOR ART
FIG. 3 is a plan view of the conventional nautical transport vehicle as shown in FIG. 2.
Figure 4:
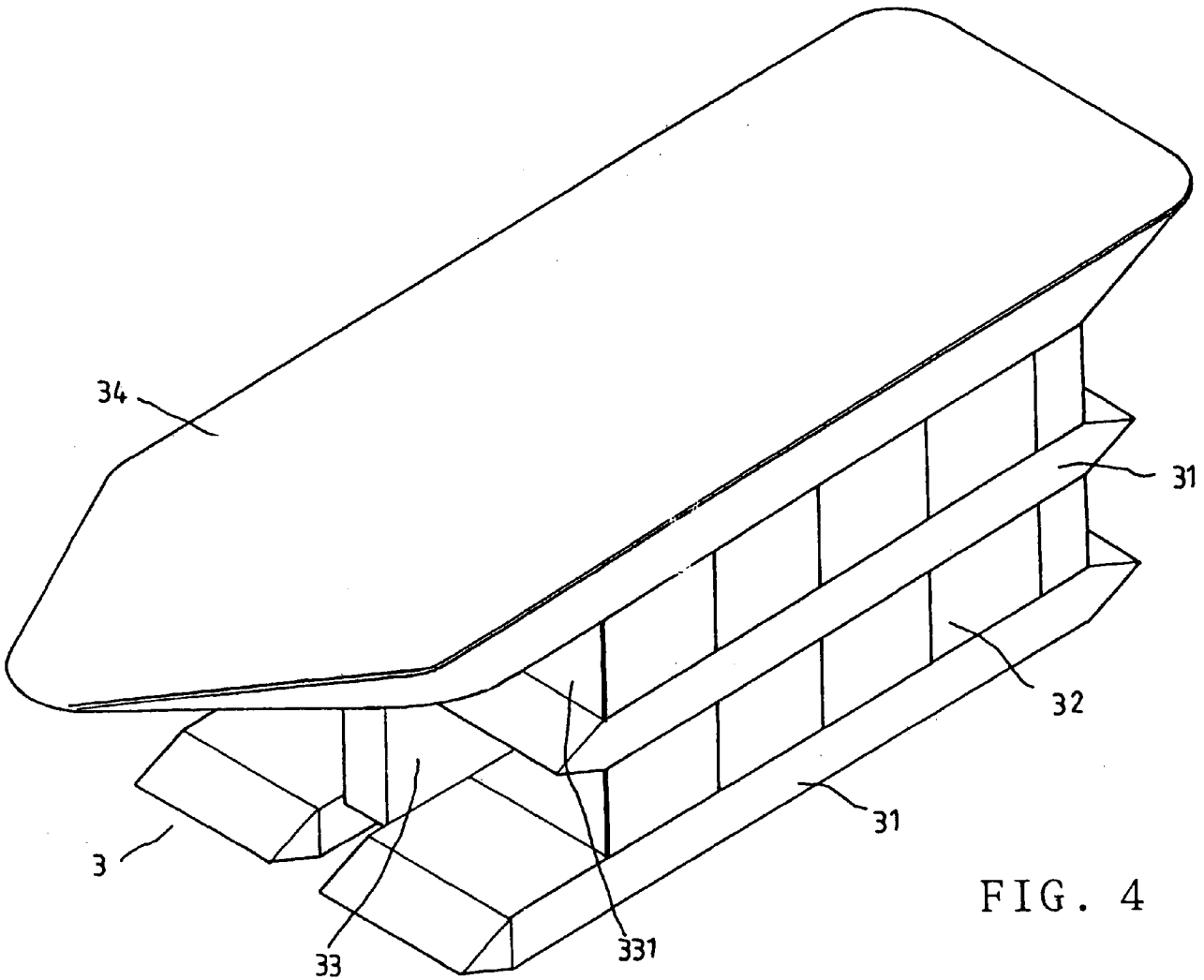
FIG. 4 is a perspective view of a nautical transport vehicle in accordance with the preferred embodiment of the present invention.

Referring to the drawings and initially to FIGS. 4 and 5, a nautical transport vehicle 3 in accordance with the preferred embodiment of the present invention comprises at least one floating member 31, at least one longitudinal fin 32 pivotally mounted on the floating member 31, and at least one corresponding plate 33 mounted on the floating member 31 and parallel with the longitudinal fin 32, thereby defining a gap 331 between the corresponding plate 33 and the longitudinal fin 32 to allow a water flow passing through the gap 331 so as to reduce a resistance to a forward movement of the water flow and to adjust a turning angle of the floating member 31.

As shown in FIG. 4, the nautical transport vehicle 3 comprises two layers of laminating longitudinal fins 32, and a floating member 31 mounted between the two layers of laminating longitudinal fins 32.

As shown in FIG. 5, the nautical transport vehicle 3 comprises two symmetrically arranged floating members 31 each having a hollow inside and each having a planar bottom to have a greater buoyancy.

Thus, the nautical transport vehicle 3 is immersed in the water stably to form a balance support, so that the ship mounted on the nautical transport vehicle 3 is flush rested on the water surface smoothly to obtain tension and buoyancy efficiently.

Figure 6:
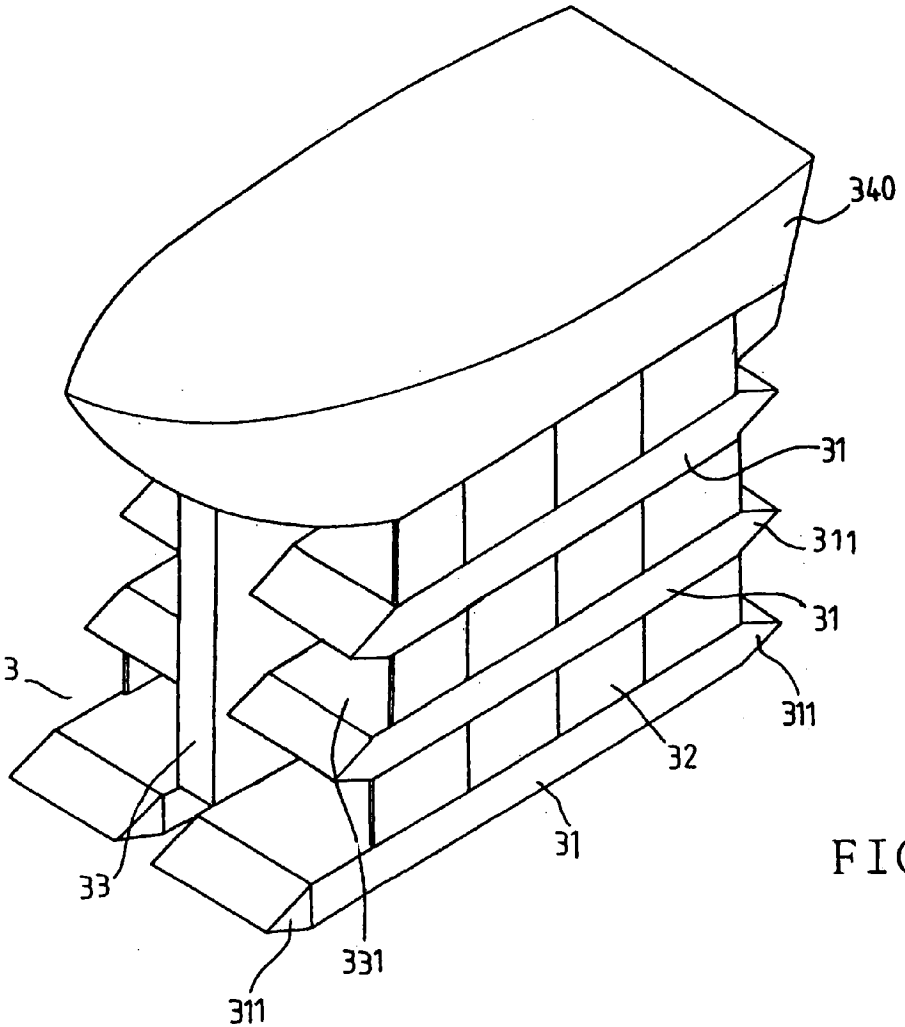
FIG. 6 is a perspective view of a nautical transport vehicle in accordance with another embodiment of the present invention.
Figure 7:
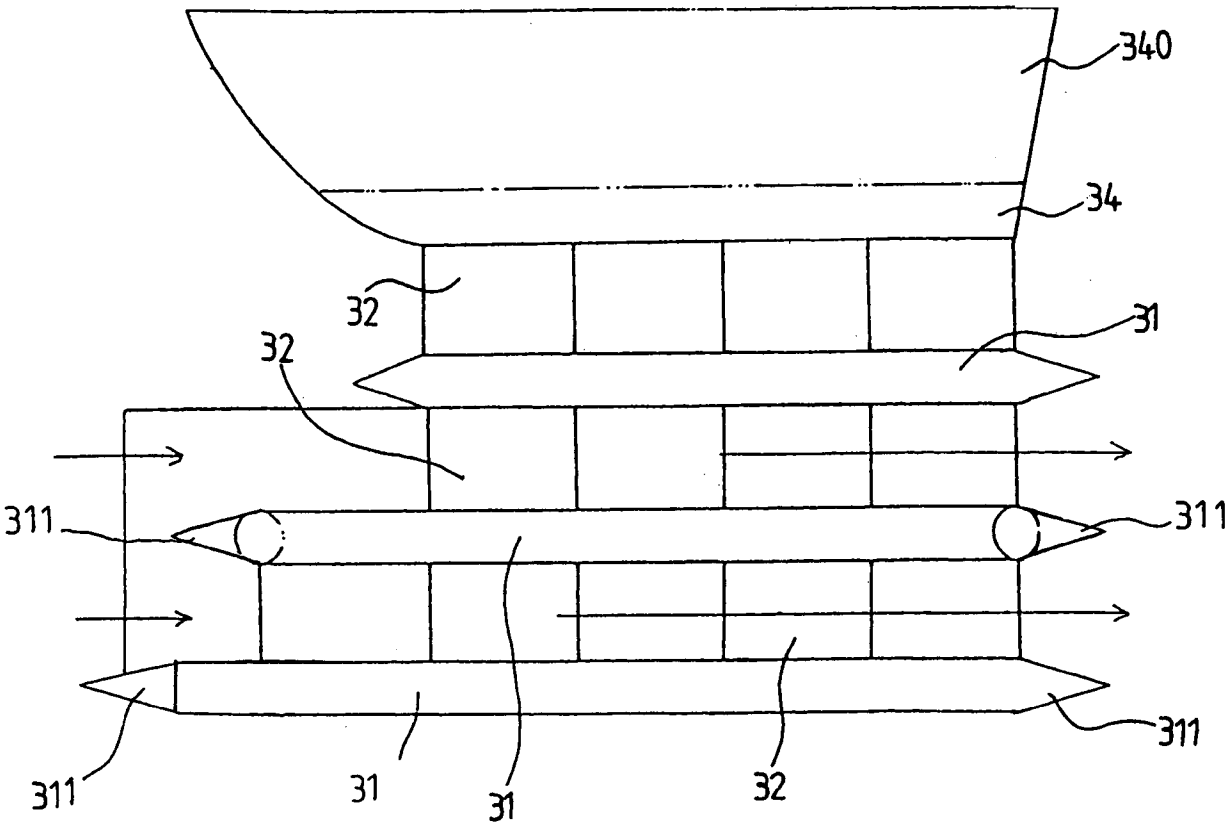
FIG. 7 is a plan view of the nautical transport vehicle as shown in FIG. 6.
Figure 8:
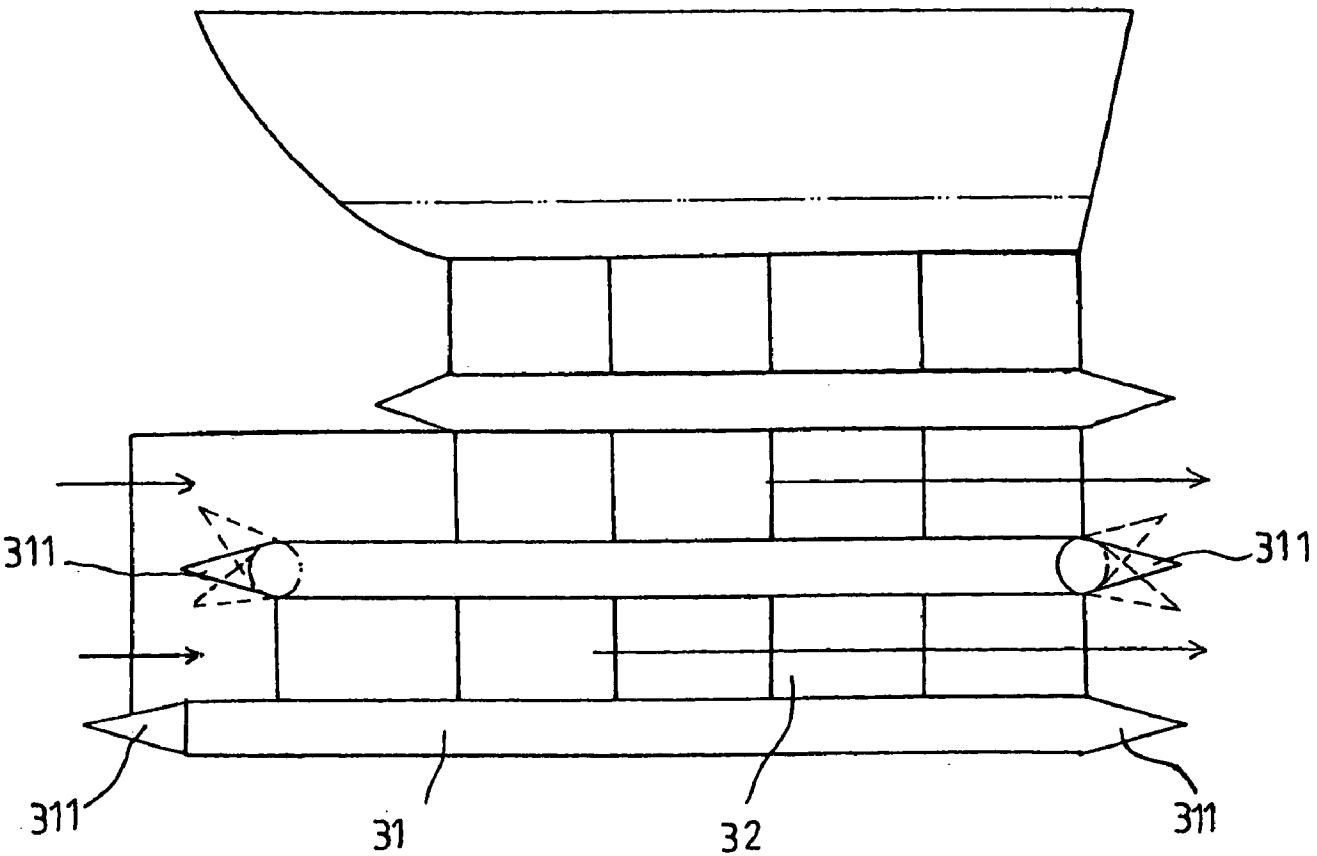
FIG. 8 is a schematic operational view of the nautical transport vehicle as shown in FIG. 7.

As shown in FIGS. 6-8, the nautical transport vehicle 3 comprises multiple layers of laminating longitudinal fins 32, and multiple floating members 31 mounted between the multiple layers of laminating longitudinal fins 32.

Thus, the nautical transport vehicle 3 has an adjustable height so that the nautical transport vehicle 3 is available for a deeper marine zone.

In addition, the nautical transport vehicle 3 further comprises a connecting plate 34 mounted on the corresponding plate 33 and juxtaposed to a bottom of a ship 340 for attaching the nautical transport vehicle 3 to the bottom of the ship 340.

Thus, the nautical transport vehicle 3 is attached to a common ship 340 and is immersed in the water so as to function as a draft balance mechanism in the water. Alternatively, the upper floating members 31 are located above the water so as to function as an engine room or a deck.

In addition, the nautical transport vehicle 3 further comprises a plurality of pivot members 311 mounted on the floating members 31 to pivot with the water flow upward and downward so as to reduce the resistance to the forward movement of the water flow.

Thus, when the nautical transport vehicle 3 is located at a lower level, the water flow lifts the pivot members 311 to provide a buoyant effect to the nautical transport vehicle 3 and when the nautical transport vehicle 3 is located at a higher level, the water flow depresses the pivot members 311 to provide a diving effect to the nautical transport vehicle 3. In addition, the pivot members 311 are pivoted with the water flow upward and downward so as to reduce the resistance to the forward movement of the water flow.

Figure 9:
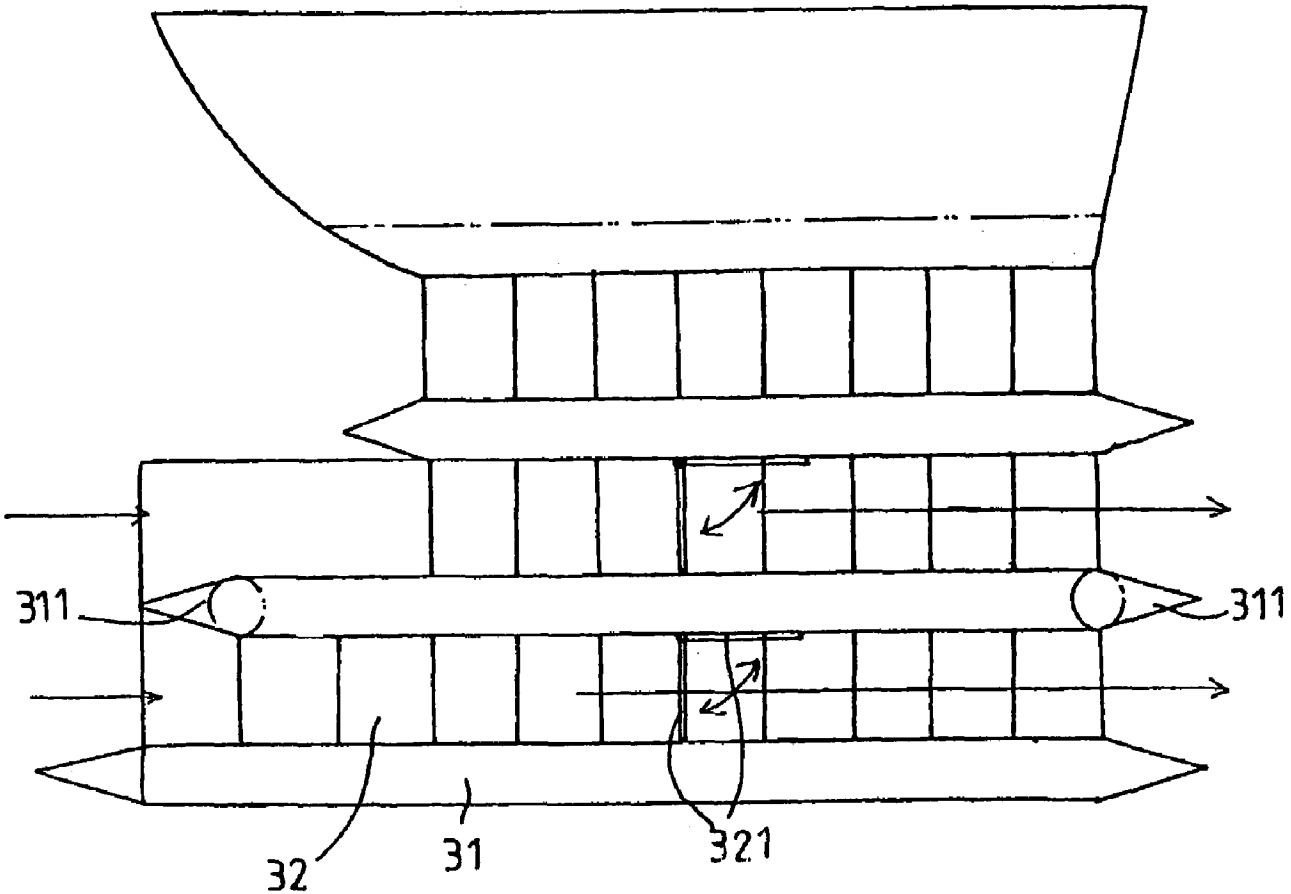
FIG. 9 is a plan view of a nautical transport vehicle in accordance with another embodiment of the present invention.
Figure 10:
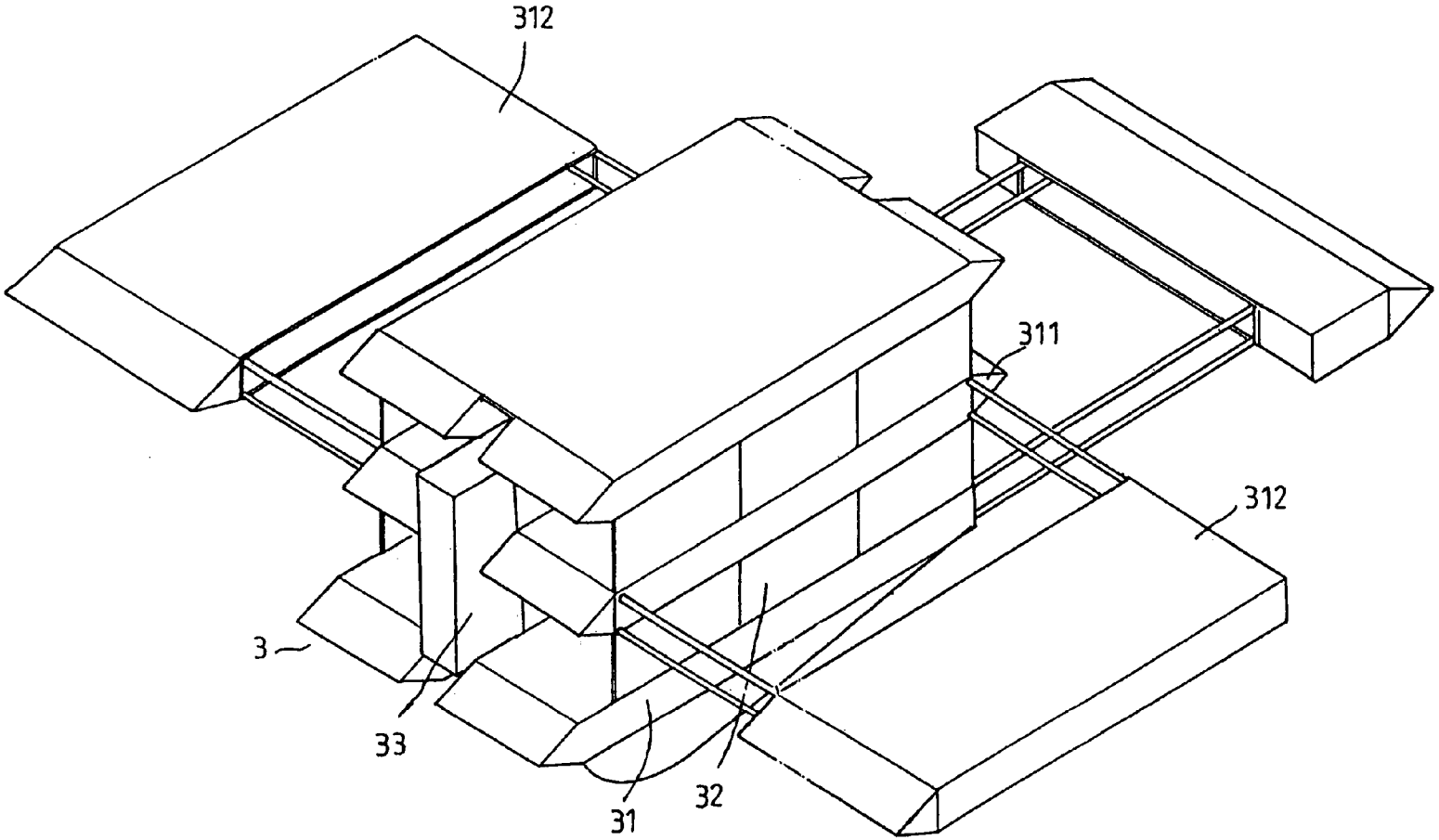
FIG. 10 is a perspective view of a nautical transport vehicle in accordance with another embodiment of the present invention.
Figure 11:
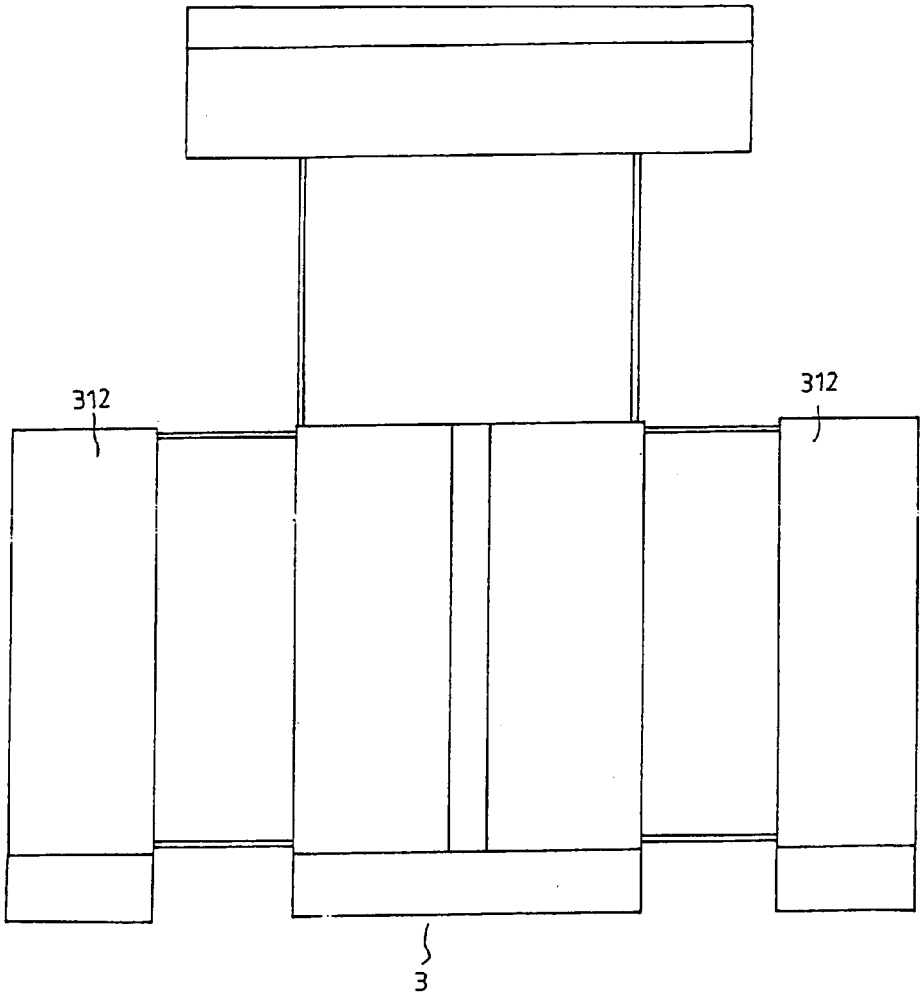
FIG. 11 is a plan view of the nautical transport vehicle as shown in FIG. 10.
Figure 12:
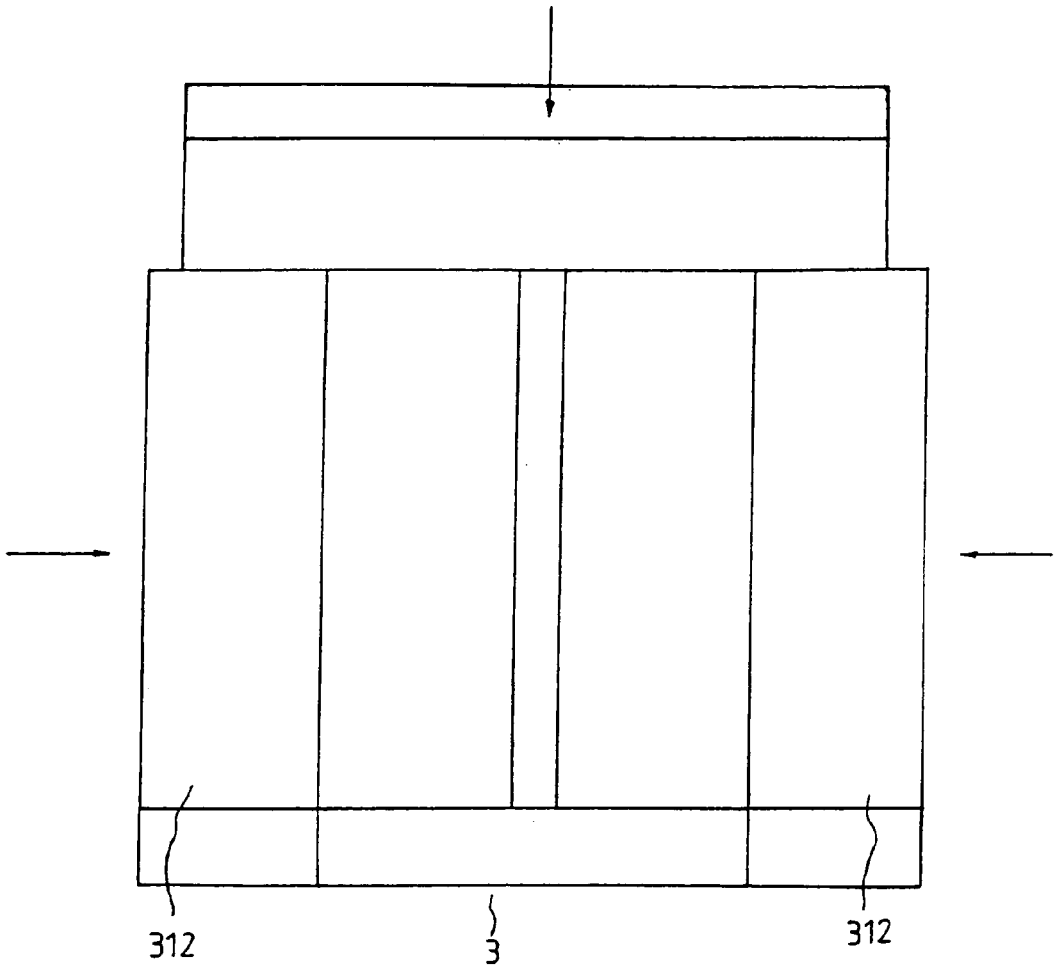
FIG. 12 is a plan view of the nautical transport vehicle as shown in FIG. 10.
Figure 13:
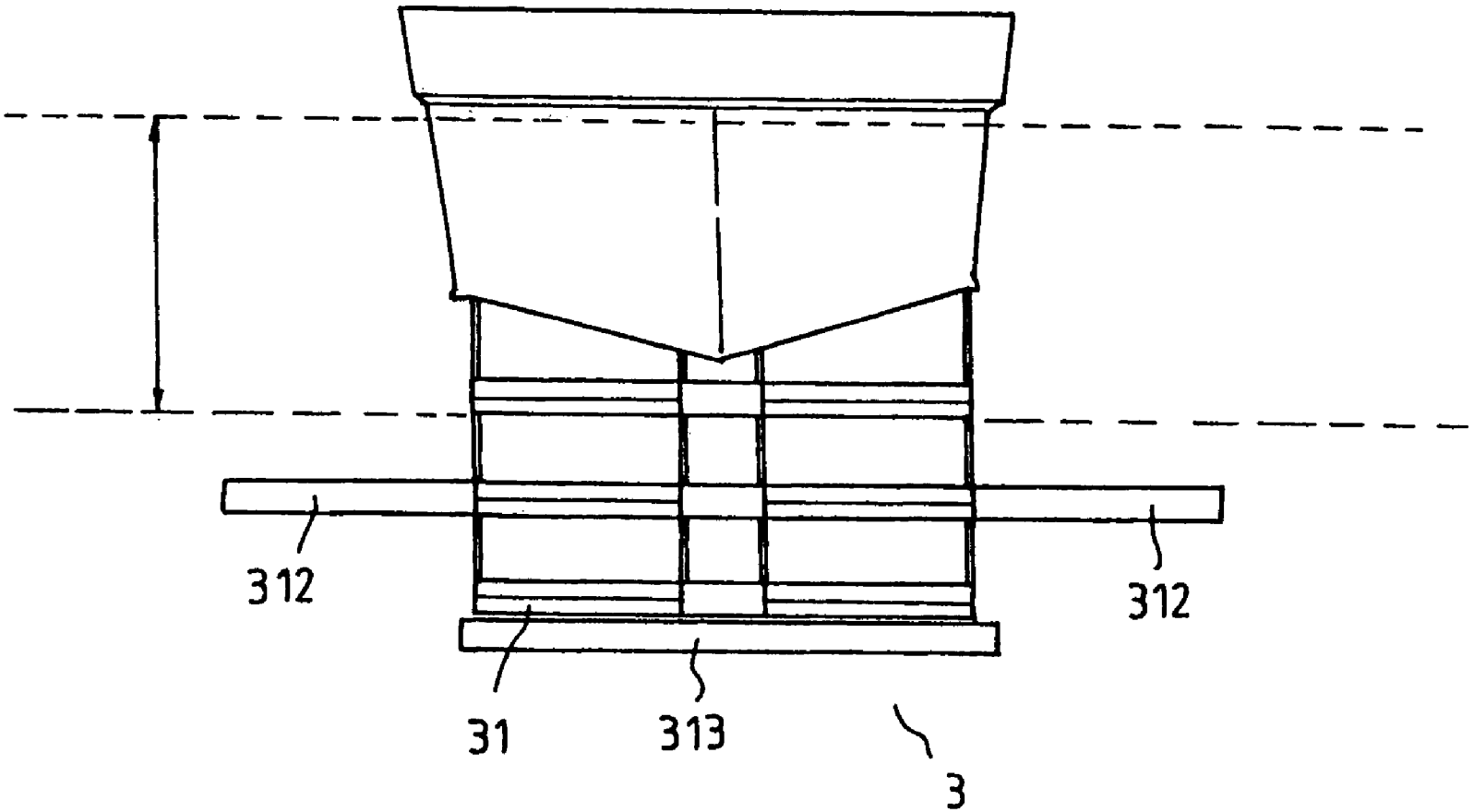
FIG. 13 is a plan view of the nautical transport vehicle as shown in FIG. 10.

As shown in FIG. 9, the nautical transport vehicle 3 further comprises a plurality of control gates 321 each pivotally mounted between any two adjacent longitudinal fins 32 and each mounted between each of the longitudinal fins 32 and the corresponding plate 33 to provide a resistance to the forward movement of the water flow so as to reduce the velocity of the nautical transport vehicle 3.

Thus, the control gates 321 are pivoted to form an obstruction to passage of the water flow to provide a braking effect so as to reduce the velocity of the nautical transport vehicle 3, thereby decreasing consumption of the power.

As shown in FIGS. 10-13, the nautical transport vehicle 3 further comprises a plurality of foils 312 retractably mounted on the floating members 31 to expand outward to increase the area of the nautical transport vehicle 3.

Thus, the foils 312 are expanded outward to increase the area of the nautical transport vehicle 3 to enhance stability and balance of the nautical transport vehicle 3 and to adjust the draft effect of the nautical transport vehicle 3.

Figure 14:
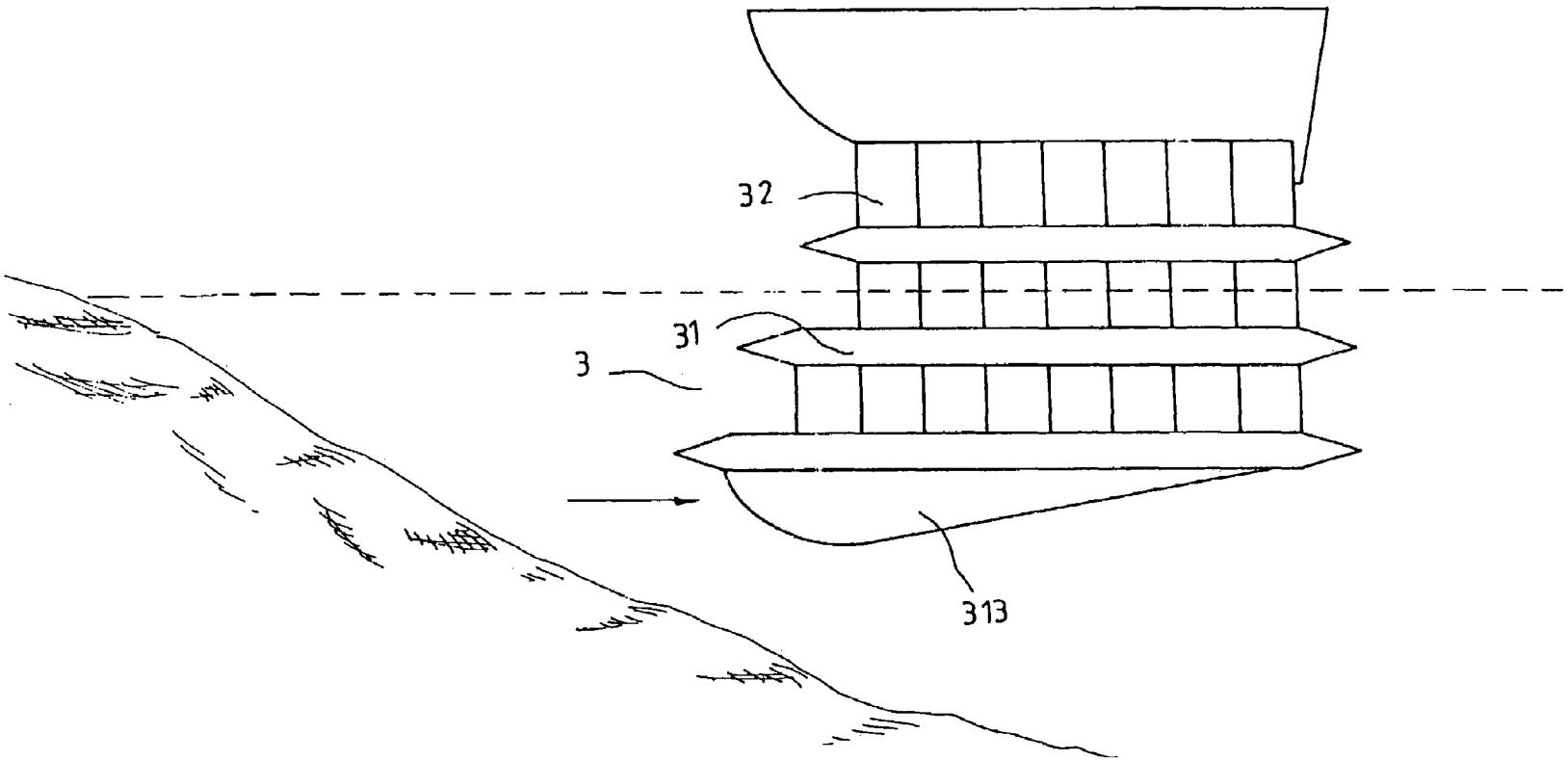
FIG. 14 is a plan view of a nautical transport vehicle in accordance with another embodiment of the present invention.
Figure 15:
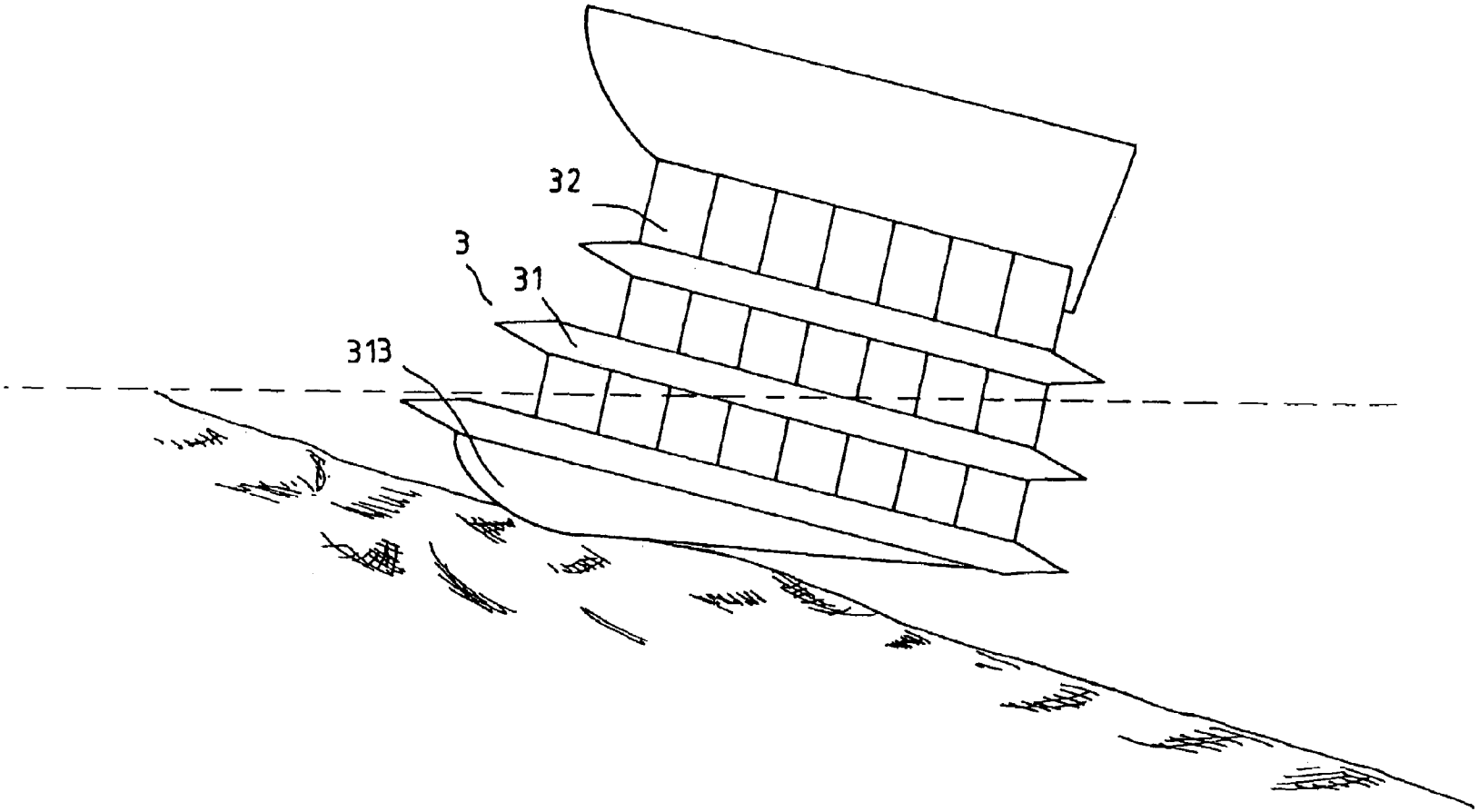
FIG. 15 is a schematic operational view of the nautical transport vehicle as shown in FIG. 14.
Figure 16:
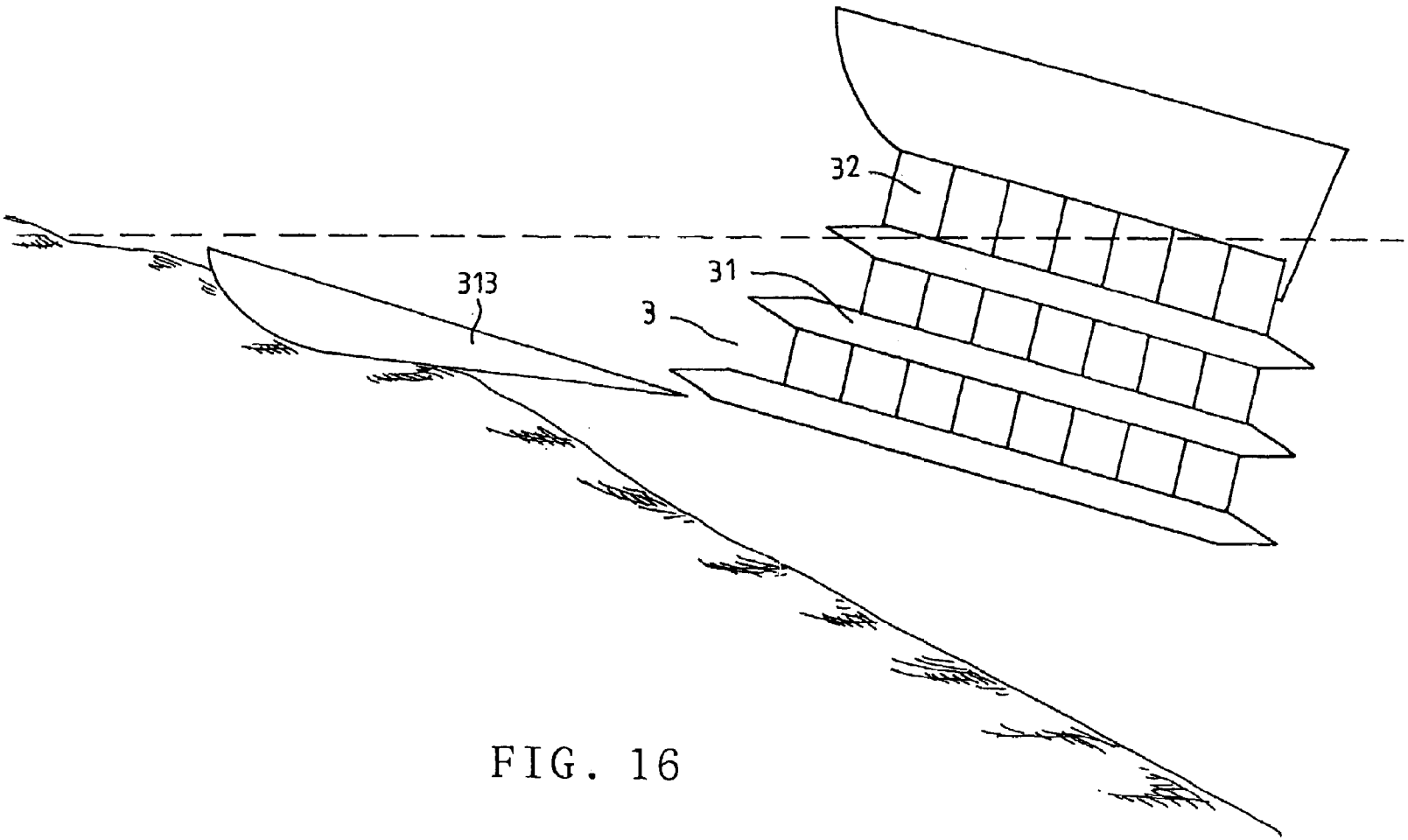
FIG. 16 is a schematic operational view of the nautical transport vehicle as shown in FIG. 15.

As shown in FIGS. 14-16, the nautical transport vehicle 3 further comprises an attachment float 313 detachably mounted on a bottom of the floating members 31. Preferably, the attachment float 313 has a substantially arc-shaped profile and has a height gradually reduced from a forward end to a rearward end thereof.

Thus, the attachment float 313 is detached from the floating members 31 to prevent the nautical transport vehicle 3 from getting aground.

Figure 17:
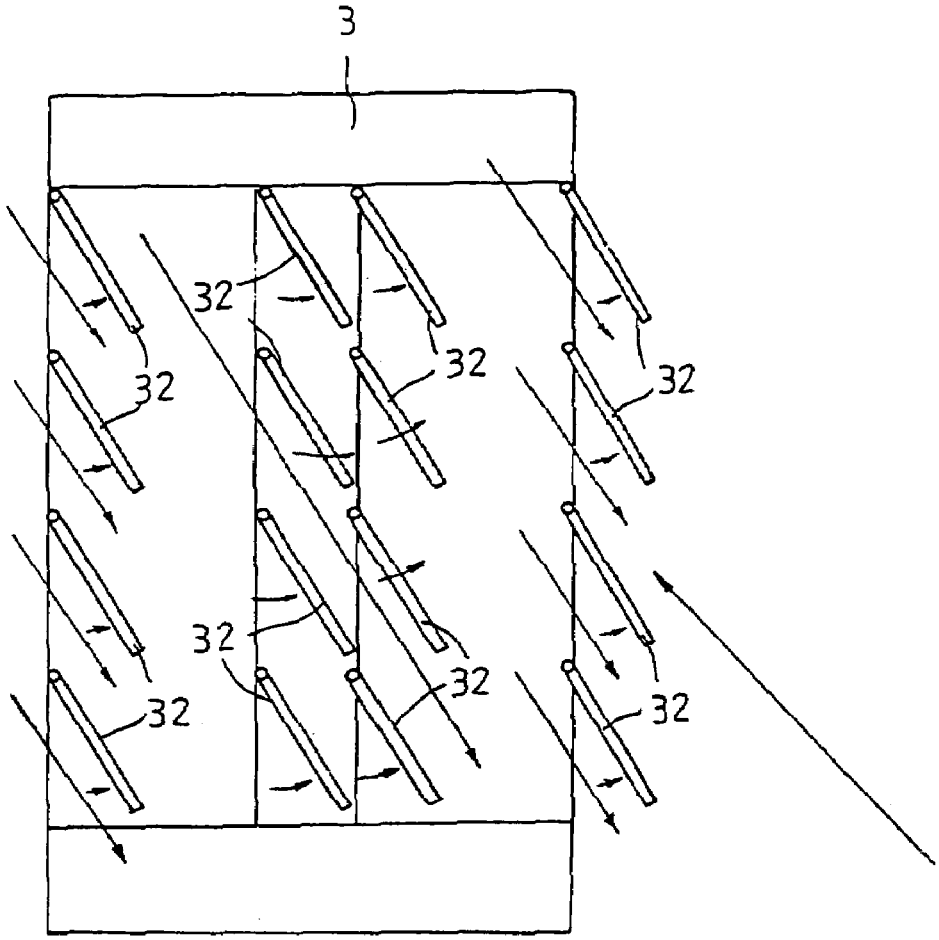
FIG. 17 is a plan operational view of the nautical transport vehicle as shown in FIG. 6.
Figure 18:
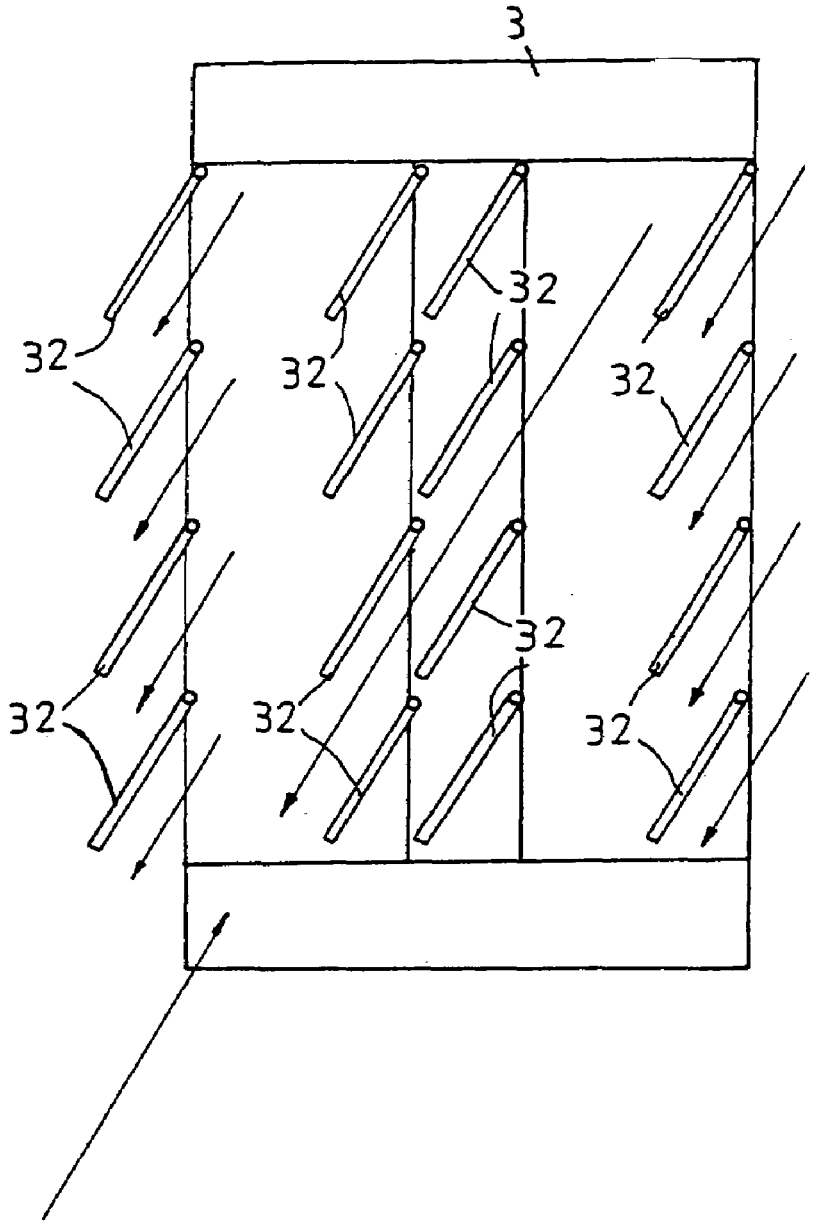
FIG. 18 is a plan operational view of the nautical transport vehicle as shown in FIG. 6.

As shown in FIGS. 17 and 18, the nautical transport vehicle 3 comprises a plurality of longitudinal fins 32 pivotally mounted on the floating member 31.

Thus, the longitudinal fins 32 are pivoted with the water flow to allow the water flow passing through the longitudinal fins 32 so as to reduce the resistance to the forward movement of the water flow. In addition, the longitudinal fins 32 are pivoted to adjust directions with the water flow so as to adjust the turning angle of the nautical transport vehicle 3.

Accordingly, the nautical transport vehicle is assembled and disassembled easily and conveniently, thereby greatly facilitating assembly and disassembly of the nautical transport vehicle. In addition, the nautical transport vehicle 3 is immersed in the water stably to form a balance support, so that the ship mounted on the nautical transport vehicle 3 is flush rested on the water surface smoothly to obtain tension and buoyancy efficiently. Further, the longitudinal fins 32 are pivoted with the water flow to allow the water flow passing through the longitudinal fins 32 so as to reduce the resistance to the forward movement of the water flow. Further, the longitudinal fins 32 are pivoted to adjust directions with the water flow so as to adjust the turning angle of the nautical transport vehicle 3. Further, the control gates 321 are pivoted to form an obstruction to passage of the water flow to provide a braking effect so as to reduce the velocity of the nautical transport vehicle 3, thereby decreasing consumption of the power. Further, the pivot members 311 are pivoted with the water flow upward and downward so as to reduce the resistance to the forward movement of the water flow. Further, the foils 312 are expanded outward to increase the area of the nautical transport vehicle 3 to enhance stability and balance of the nautical transport vehicle 3 and to adjust the draft effect of the nautical transport vehicle 3. Further, the attachment float 313 is detached from the floating members 31 to prevent the nautical transport vehicle 3 from getting aground. Further, the nautical transport vehicle 3 has an adjustable height so that the nautical transport vehicle 3 is available for a deeper marine zone. Further, the nautical transport vehicle 3 is attached to a common ship 340 and is immersed in the water so as to function as a draft balance mechanism in the water. Further, the upper floating members 31 are located above the water so as to function as an engine room or a deck. Further, when the nautical transport vehicle 3 is located at a lower level, the water flow lifts the pivot members 311 to provide a buoyant effect to the nautical transport vehicle 3 and when the nautical transport vehicle 3 is located at a higher level, the water flow depresses the pivot members 311 to provide a diving effect to the nautical transport vehicle 3. Further, the upper floating members 31 are located above the water so as to function as an engine room or a deck.

The invention claimed is:

1. A nautical transport vehicle, comprising:

at least one floating member;

at least one longitudinal fin pivotally mounted on the floating member and extended in a longitudinal direction of the floating member; and at least one corresponding plate mounted on the floating member and extended in the longitudinal direction in parallel with the longitudinal fin, thereby defining a gap between the floating member, the corresponding plate and the longitudinal fin to allow a water flow passing through the gap so as to reduce a resistance to a forward movement of the water flow and to adjust a turning angle of the floating member;

wherein the nautical transport vehicle comprises a plurality of longitudinal fins juxtaposed to each other and further comprises a plurality of control gates each pivotally mounted between any two adjacent longitudinal fins.

2. The nautical transport vehicle in accordance with claim 1, further comprising a plurality of pivot members mounted on the floating member to pivot with the water flow upward and downward so as to reduce the resistance to the forward movement of the water flow, wherein the pivot members are located at two opposite ends of the floating member and are pivotable in a direction perpendicular to that of the longitudinal fin.

3. The nautical transport vehicle in accordance with claim 1, further comprising a plurality of foils retractably mounted on a periphery of the floating member to expand outward to increase the area of the nautical transport vehicle.

4. The nautical transport vehicle in accordance with claim 1, further comprising an attachment float detachably mounted on a bottom of the floating member, wherein the attachment float has a substantially arc-shaped profile and has a height gradually reduced from a forward end to a rearward end thereof.

5. The nautical transport vehicle in accordance with claim 1, wherein the nautical transport vehicle comprises two symmetrically arranged floating members.

6. The nautical transport vehicle in accordance with claim 1, wherein the floating member has a hollow inside.

7. A nautical transport vehicle, comprising:

at least one floating member;

at least one longitudinal fin pivotally mounted on the floating member and extended in a longitudinal direction of the floating member; and at least one corresponding plate mounted on the floating member and extended in the longitudinal direction in parallel with the longitudinal fin, thereby defining a gap between the floating member, the corresponding plate and the longitudinal fin to allow a water flow passing through the gap so as to reduce a resistance to a forward movement of the water flow and to adjust a turning angle of the floating member;

wherein the nautical transport vehicle comprises multiple layers of vertically laminating longitudinal fins, and multiple floating members located between the multiple layers of vertically laminating longitudinal fins;

the nautical transport vehicle further comprises a plurality of control gates each pivotally mounted between each of the longitudinal fins and the corresponding plate.

8. The nautical transport vehicle in accordance with claim 1, further comprising a connecting plate having a first face mounted on a top of the longitudinal fin and the corresponding plate and a second face juxtaposed to a bottom of a ship for attaching the nautical transport vehicle to the bottom of the ship.

* * * * *